US010199154B2

(12) United States Patent
Hong et al.

(10) Patent No.: US 10,199,154 B2
(45) Date of Patent: Feb. 5, 2019

(54) COIL COMPONENT AND METHOD OF MANUFACTURING THE SAME

(71) Applicant: SAMSUNG ELECTRO-MECHANICS CO., LTD., Suwon-si, Gyeonggi-do (KR)

(72) Inventors: Seok Il Hong, Suwon-si (KR); Jae Yeol Choi, Suwon-si (KR); Jong Bong Lim, Suwon-si (KR); Ju Hwan Yang, Suwon-si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 77 days.

(21) Appl. No.: 15/200,700

(22) Filed: Jul. 1, 2016

(65) Prior Publication Data

US 2017/0140866 A1 May 18, 2017

(30) Foreign Application Priority Data

Nov. 18, 2015 (KR) ..... 10-2015-0161637

(51) Int. Cl.
*H01F 27/28* (2006.01)
*H01F 27/245* (2006.01)
(Continued)

(52) U.S. Cl.
CPC ..... *H01F 27/2804* (2013.01); *H01F 1/26* (2013.01); *H01F 17/0013* (2013.01);
(Continued)

(58) Field of Classification Search
CPC ..... H01F 5/00; H01F 27/28; H01F 27/2804; H01F 27/29; H01F 27/255; H01F 27/245
(Continued)

(56) References Cited

U.S. PATENT DOCUMENTS 6,996,892 B1 * 2/2006 Dening ..... H01F 17/0013 29/602.1
2004/0080866 A1 4/2004 Hsiao et al.
(Continued)

FOREIGN PATENT DOCUMENTS

JP 2004-040001 A 2/2004
JP 2004-146045 A 5/2004
(Continued)

*Primary Examiner* — Tsz Chan
(74) *Attorney, Agent, or Firm* — McDermott Will & Emery LLP

(57) ABSTRACT

A coil component and a method of manufacturing the coil component are provided. The coil component includes a coil part, a body, and an electrode. The coil part includes a support member, a first coil layer disposed on one surface of the support member, and a second coil layer disposed on the first coil layer. The body includes a magnetic material covering the coil part. The electrode is disposed on the body and is connected to the coil part. The first and second coil layers may each include an insulating layer having a pattern in a planar coil shape and a conductor layer disposed in the pattern and including a seed layer and a plating layer. Additionally, seed layers of the first and second coil layers may be disposed differently in the conductor layers of the first and second coil layers.

19 Claims, 18 Drawing Sheets

(51) Int. Cl.

| | |
|---|---|
| ***H01F 27/255*** | (2006.01) |
| ***H01F 27/29*** | (2006.01) |
| ***H01F 41/02*** | (2006.01) |
| ***H01F 41/04*** | (2006.01) |
| ***H01F 41/10*** | (2006.01) |
| ***H01F 1/26*** | (2006.01) |
| ***H01F 17/00*** | (2006.01) |
| ***H01F 17/04*** | (2006.01) |

(52) U.S. Cl.
CPC ..... *H01F 17/04* (2013.01); *H01F 27/245* (2013.01); *H01F 27/255* (2013.01); *H01F 27/29* (2013.01); *H01F 27/292* (2013.01); *H01F 41/0233* (2013.01); *H01F 41/041* (2013.01); *H01F 41/042* (2013.01); *H01F 41/046* (2013.01); *H01F 41/10* (2013.01); *H01F 2027/2809* (2013.01)

(58) Field of Classification Search
USPC ..... 336/200, 232
See application file for complete search history.

(56) References Cited

U.S. PATENT DOCUMENTS

| | | | | |
|---|---|---|---|---|
| 2005/0195062 | A1* | 9/2005 | Yoshida | H01F 27/2804 336/200 |
| 2008/0136575 | A1* | 6/2008 | Edo | H01F 27/2804 336/200 |
| 2012/0212919 | A1* | 8/2012 | Mano | H05K 1/185 361/782 |
| 2013/0222101 | A1* | 8/2013 | Ito | H01F 17/04 336/83 |
| 2015/0162744 | A1* | 6/2015 | Liu | H01L 24/05 361/111 |
| 2016/0078998 | A1* | 3/2016 | Park | H01F 17/0013 336/105 |

FOREIGN PATENT DOCUMENTS

| | | | |
|---|---|---|---|
| JP | 2007067214 | A * | 3/2007 |
| JP | 2014229739 | A * | 12/2014 |

* cited by examiner

COIL COMPONENT AND METHOD OF MANUFACTURING THE SAME

CROSS-REFERENCE TO RELATED APPLICATION

This application claims the priority and benefit of Korean Patent Application No. 10-2015-0161637, filed on Nov. 18, 2015 with the Korean Intellectual Property Office, the disclosure of which is incorporated herein by reference.

BACKGROUND

The present disclosure relates to a coil component and a method of manufacturing the same.

As electronic devices such as a digital TVs, mobile phones, and laptop computers are being miniaturized and thinned, coil components used in these electronic devices also need to be miniaturized and thinned. To meet such need, research and development of various types of coil components including winding type and thin type coil components has actively progressed.

Meanwhile, in order to form coil patterns used in thin film type coil components, the coil patterns are generally formed by forming a seed layer on a substrate in advance, coating and developing a patterning photo imageable material on the seed layer, and then providing copper plating between the patterns. In these approaches, a so-called semi additive process (SAP) is used for removing the insulating photo imageable material and the seed layer using flash etching.

However, the manufacturing method of the prior art uses both the patterning photo imageable material and the insulating photo imageable material, and therefore manufacturing costs may be increased and productivity may be reduced. Further, when a lower layer is not flat due to the flash etching, or the like, a margin of a line width may be reduced during the formation of the coil patterns in a multilayer. Further, a coil loss rate may be increased.

SUMMARY

An aspect of the present disclosure provides a coil component and a method of effectively manufacturing the same capable of increasing productivity, reducing a coil loss rate, and improving resolution of a micro line width.

According to an aspect of the present disclosure, a coil component may be manufactured by changing a printed circuit board method using a copper clad laminate (CCL), or the like, and a damascene method to be suited for manufacturing of the coil component.

According to one aspect of the present disclosure, a coil component includes a coil part, a body, and an electrode. The coil part includes a support member, a first coil layer disposed on one surface of the support member, and a second coil layer disposed on the first coil layer. The body includes a magnetic material covering the coil part. The electrode is disposed on the body and is connected to the coil part. The first and second coil layers each include an insulating layer having a pattern in a planar coil shape and a conductor layer disposed in the pattern and including a seed layer and a plating layer. Additionally, seed layers of the first and second coil layers have different shapes.

According to another aspect of the present disclosure, a method of manufacturing a coil component includes forming a coil part, forming a body by covering the coil part with a magnetic material, and forming, on the body, an electrode connected to a coil of the coil part. The forming of the coil part includes providing a support member on which a metal layer is disposed on at least one surface. The metal layer is patterned to have a planar coil shape, and an inside insulating layer is formed to have a pattern in the planar coil shape on the support member. In turn, a plating layer is formed in the pattern in the inside insulating layer based on the patterned metal layer to form an inside conductor layer. An insulating film is staked on the inside insulating layer and the inside conductor layer, and an outside insulating layer is formed to have a pattern in a planar coil shape on the insulating film. A seed layer is formed on a surface of the outside insulating layer, a wall surface of the outside insulating layer, and a surface of the insulating film exposed in the pattern of the outside insulating layer. A plating layer is formed on the surface of the outside insulating layer based on the seed layer and in the pattern of the outside insulating layer. Finally, the seed layer and the plating layer formed on the surface of the outside insulating layer are planarized to form an outside conductor layer.

According to a further aspect of the present disclosure, a coil component includes a support member, first and second coil layers respectively disposed on one surface of the support member and on another surface of the support member opposite to the one surface, a through conductor penetrating through the support member to connect the first and second coil layers with each other, and external electrodes connected to ends of the first and second coil layers. The first coil layer includes a first insulating layer disposed to form a planar coil pattern on the one surface of the support member, and a first conductor layer filling gaps in the planar coil pattern of the first insulating layer. The second coil layer includes a second insulating layer disposed according to a planar coil pattern on the other surface of the support member, and a second conductor layer filling gaps in the planar coil pattern of the second insulating layer. The through conductor directly connects the first and second conductor layers with each other.

According to a further aspect of the present disclosure, a method includes providing a support member on which a metal layer is disposed on first and second opposing surfaces thereof. The metal layer is patterned to have a planar coil shape exposing portions of the first and second opposing surfaces of the support member. An inside insulating layer is formed to have a pattern in the planar coil shape on the exposed portions of each of the first and second opposing surfaces of the support member. A plating layer is formed in the pattern in each inside insulating layer based on the patterned metal layer to form an inside conductor layer. An insulating film is then staked on the inside insulating layer and the inside conductor layer formed on each of the first and second opposing surfaces of the support member.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
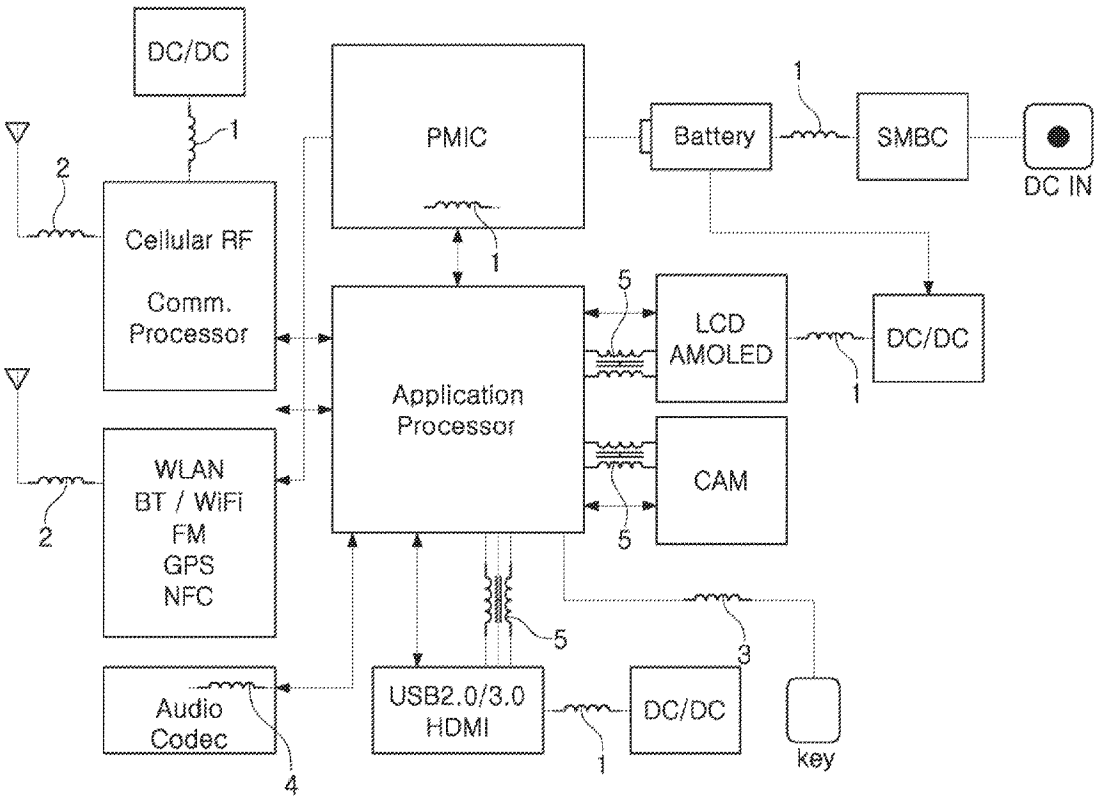
FIG. 1 is a diagram schematically showing an example of a coil component being used in an electronic device.

Hereinafter, embodiments of the present disclosure will be described as follows with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another member, component, region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's positional relationship relative to one or more other element(s) as shown in the figures. It will be understood that the spatially relative terms are intended to encompass different orientations of the device in use or operation in addition to the orientation depicted in the figures. For example, if the device in the figures is turned over, elements described as "above," or "upper" relative to other elements would then be oriented "below," or "lower" relative to the other elements or features. Thus, the term "above" can encompass both the above and below orientations depending on a particular direction of the devices, elements, or figures. The device may be otherwise oriented (rotated 90 degrees or at other orientations) and the spatially relative descriptors used herein may be interpreted accordingly.

The terminology used herein describes particular illustrative embodiments only, and the present disclosure is not limited thereby. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups, but do not preclude the presence or addition of one or more other features, integers, steps, operations, members, elements, and/or groups.

Hereinafter, embodiments of the present disclosure will be described with reference to schematic views illustrating embodiments of the present disclosure. In the drawings, components having ideal shapes are shown. However, variations from these shapes, for example due to variability in manufacturing techniques and/or tolerances, also fall within the scope of the disclosure. Thus, embodiments of the present disclosure should not be construed as being limited to the particular shapes of regions shown herein, but should more generally be understood to include changes in shape resulting from manufacturing methods and processes. The following embodiments may also be constituted by one or a combination thereof.

The present disclosure describes a variety of configurations, and only illustrative configurations are shown herein. However, the disclosure is not limited to the particular illustrative configurations presented herein, but extends to other similar/analogous configurations as well.

Hereinafter, a coil component according to the present disclosure will be described.

Electronic Device

FIG. 1 is a diagram schematically showing an example of a coil component being used in an electronic device. Referring to FIG. 1, it may be appreciated that electronic devices use various kinds of electronic components. For example, the electronic device of FIG. 1 may include one or more of an application processor, a DC/DC converter, a communication processor, one or more transceivers configured for communication using wireless local area network (WLAN), bluetooth (BT), Wi-Fi, frequency modulation (FM), global positioning service (GPS), and/or near field communication (NFC) standards, a power management integrated circuit (PMIC), a battery, a switch-mode battery charger (SMBC), a liquid crystal display (LCD) active-matrix organic light-emitting diode (AMOLED), an audio codec, a universal serial bus (USB) 2.0/3.0 interface and/or a high-definition multimedia interface (HDMI), a conditional access module (CAM), or the like. In this case, various kinds of coil components may be appropriately used in these electronic components or in the electronic device to serve various purposes such as to remove noise or the like. For example, the coil components in the electronic device may include power inductors 1, high frequency inductors (HF inductors) 2, general beads 3, high frequency beads (GHz beads) 4, common mode filters 5, or the like.

In detail, the power inductors 1 may each store electricity in a magnetic field form to maintain an output voltage, thereby stabilizing a power supply, or the like. Further, the high frequency inductors (HF inductors) 2 may each match impedance to secure a required frequency, cut-off noise and AC components of signals, or the like. Further, the general beads 3 may be used to remove noise of power and signal lines, remove a high frequency ripple, or the like. Further, the high frequency beads (GHz beads) 4 may be used to remove high frequency noise of a signal line and a power line associated with audio, or the like. Further, the common mode filters 5 may be used to pass a current in a differential mode, remove only common mode noise, or the like.

The electronic device may representatively be a smartphone, but is not limited thereto. For example, the electronic device may be a personal digital assistant, a digital video camera, a digital still camera, a network system, a computer, a monitor, a television, a video game console, a smart watch, or the like. In addition, various other electronic devices may be used.

Coil Component

Hereinafter, the coil component of the present disclosure will be described in more detail. For convenience, the coil component is described as an inductor and/or a common mode filter, but is not limited thereto. The coil components of the present disclosure may also be used for various other purposes. Meanwhile, a side portion as referenced below means a portion located toward a first (lateral) direction or a second (lateral) direction for convenience, an upper portion means a portion located toward a third (upwards) direction for convenience, and a lower portion means a portion located toward a (downwards) direction opposite to the third (upwards) direction for convenience, in accordance with the directional references shown in FIG. 2. In addition, the coil component may be positioned such that the side portion, the upper portion, or the lower portion directly contacts another component that is positioned in the corresponding direction, or does not directly contact the component but is positioned adjacent to or in the direction of the component. However, the scope of claims is not necessarily limited to the direction or orientation of the coil component relative to external components as described herein.

Figure 2:
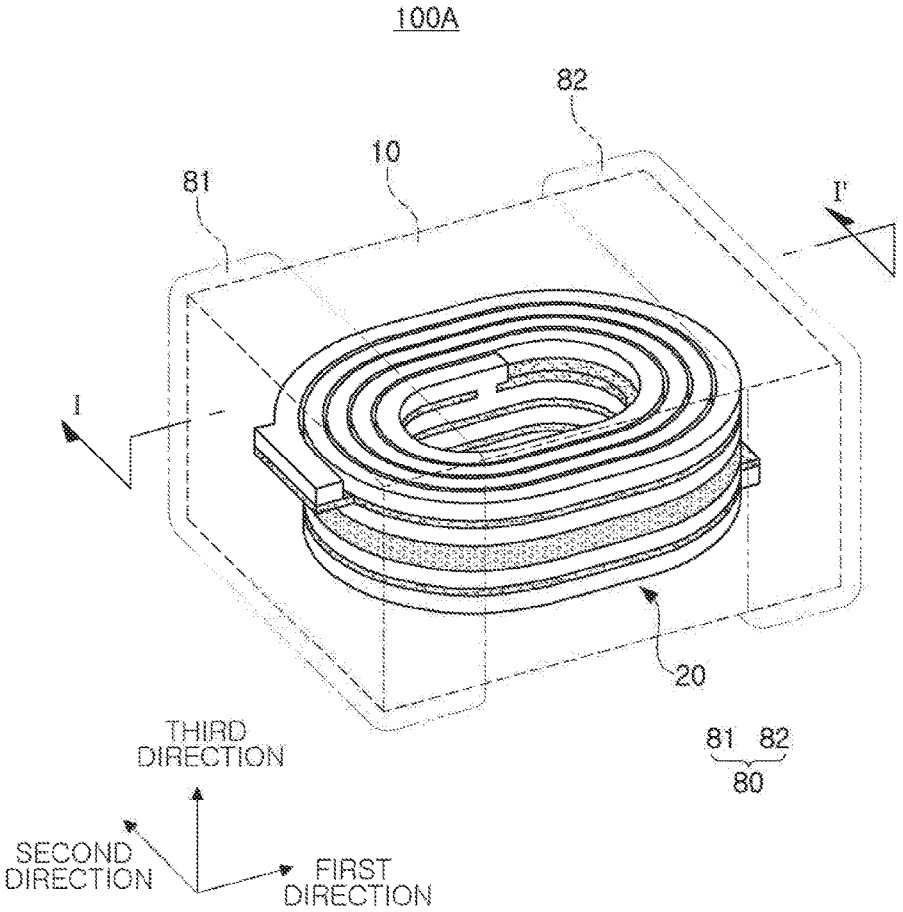
FIG. 2 is a perspective view schematically showing an example of the coil component.

FIG. 2 is a perspective view schematically showing an example of the coil component. Referring to FIG. 2, a coil component 100A according to the exemplary embodiment may include a body 10 and one or more electrode(s) 80 disposed on the body 10. A coil part 20 may be disposed in the body 10. The coil part 20 disposed in the body 10 may be covered with a magnetic material. The electrode(s) 80 may include a first electrode 81 and a second electrode 82 that are disposed on the body 10 to be spaced apart from each other. The first electrode 81 and the second electrode 82 may each be connected to different respective terminals of the coil part 20.

The body 10 may form a body of the coil component 100A and may include a first surface and a second surface facing each other in the first (e.g., length) direction, a third surface and a fourth surface facing each other in the second (e.g., width) direction, and a fifth surface and a sixth surface facing each other in the third (e.g., thickness) direction. The body 10 may have a hexahedral shape. However, a shape of the body 10 is not limited thereto. The body 10 may include the magnetic material, and the coil part 20 may be disposed in the body 10. As long as the magnetic material has magnetic properties, any magnetic material may be used without being particularly limited. For example, the magnetic material may include Fe alloys such as pure iron powder, Fe—Si-based alloy powder, Fe—Si—Al-based alloy powder, Fe—Ni-based alloy powder, Fe—Ni—Mo-based alloy powder, Fe—Ni—Mo—Cu-based alloy powder, Fe—Co-based alloy powder, Fe—Ni—Co-based alloy powder, Fe—Cr-based alloy powder, Fe—Cr—Si-based alloy powder, Fe—Ni—Cr-based alloy powder, and Fe—Cr—Al-based powder, amorphous alloys such as an Fe-based amorphous alloy and a Co-based amorphous alloy, spinel type ferrites such as a Mg—Zn-based ferrite, a Mn—Zn-based ferrite, a Mn—Mg-based ferrite, a Cu—Zn-based ferrite, a Mg—Mn—Sr-based ferrite, and a Ni—Zn-based ferrite, magnetoplumbite type ferrites such as a Ba—Zn-based ferrite, a Ba—Mg-based ferrite, a Ba—Ni-based ferrite, a Ba—Co-based ferrite, and a Ba—Ni—Co-based ferrite, garnet type ferrites such as an Y-based ferrite, or the like.

When the coil component 100A is mounted in the electronic device, the electrode(s) 80 may serve to electrically connect the coil component 100A to the electronic device. The electrode(s) 80 may include the first electrode 81 and the second electrode 82 that are disposed on the body 10 to be spaced apart from each other. The electrode(s) 80 may each include, for example, a conductive resin layer and a conductor layer formed on the conductive resin layer. The conductive resin layer may contain one or more conductive metal(s) selected from the group consisting of copper (Cu), nickel (Ni), and silver (Ag), and a thermosetting resin. The conductor layer may contain one or more selected from the group consisting of nickel (Ni), copper (Cu), and tin (Sn). For example, a nickel (Ni) layer and a tin (Sn) layer may be sequentially formed.

Figure 3:
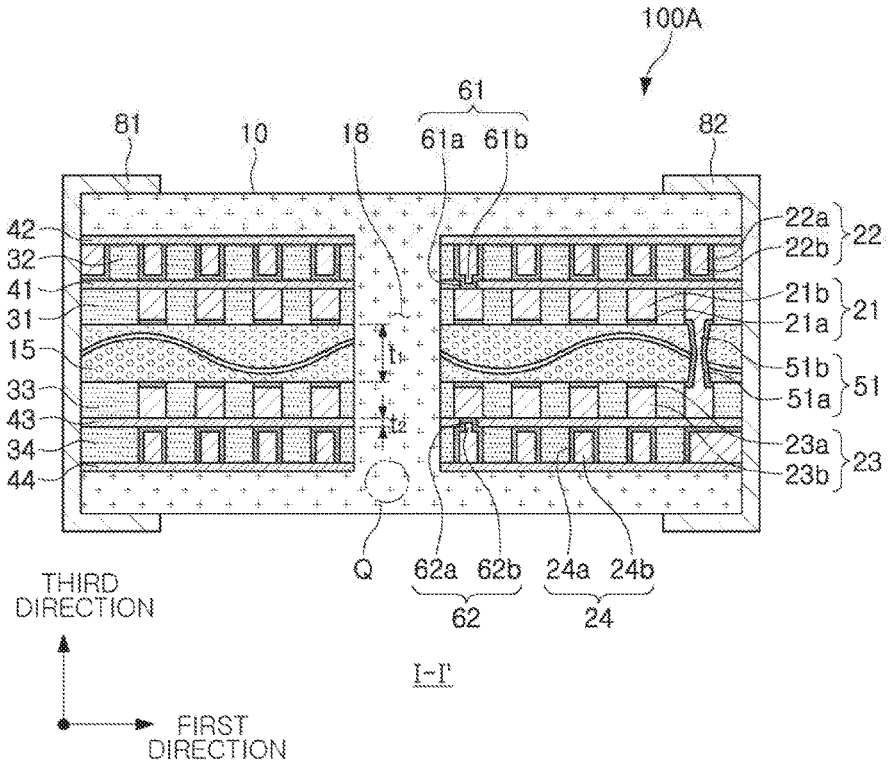
FIG. 3 is a schematic cross-sectional cut view of the coil component of FIG. 2 taken along I-I'.

FIG. 3 is a schematic cross-sectional cut view of the coil component of FIG. 2 taken along I-I'. Referring to FIG. 3, the coil part 20 may include a support member 15, first coil layers 21 and 31 disposed on one surface of the support member 15, second coil layers 22 and 32 disposed on the first coil layers 21 and 31, a first insulating film 41 disposed between the first coil layers 21 and 31 and the second coil layers 22 and 32, a first via 61 penetrating through the first insulating film 41 and connecting the first coil layers 21 and 31 and the second coil layers 22 and 32, and a second insulating film 42 disposed on the second coil layers 22 and 32. Further, the coil part 20 may include third coil layers 23 and 33 disposed on an opposite surface (the other surface) of the one surface of the support member 15, fourth coil layers 24 and 34 disposed on third coil layers 23 and 33, a third insulating film 43 disposed between the third coil layers 23 and 33 and the fourth coil layers 24 and 34, a second via 62 penetrating through the third insulating film 43 and connecting the third coil layers 23 and 33 and the fourth coil layers 24 and 34, and a fourth insulating film 44 disposed on the fourth coil layers 24 and 34. Further, the coil part 20 may include a through conductor 51 penetrating through the support member 15 and connecting the first coil layers 21 and 31 and the third coil layers 23 and 33.

The support member 15 may serve to support the coil part 20 and provide stiffness. The support member 15 may be an insulating substrate formed of an insulating resin. As the insulating resin, a thermosetting resin such as an epoxy resin, a thermoplastic resin such as polyimide, a resin formed by impregnating a reinforcing material such as a glass fiber or an inorganic filler in the thermosetting resin and the thermoplastic resin, for example, pre-preg, or the like may be used. For the support member 15 to sufficiently perform the role, a thickness t1 of the support member 15 may be thicker than a thickness t2 of each of the first to fourth insulating films 41, 42, 43, and 44.

The through conductor 51 may serve to electrically connect the first coil layers 21 and 31 and the third coil layers 23 and 33 that are disposed on both opposing surfaces of the support member 15. The through conductor 51 may include a through seed layer 51*a* disposed at a side portion of a through hole penetrating through the support member 15 and a through plating layer 51*b* disposed on the through seed layer 51*a*. The through seed layer 51*a* may be integrated with a first seed layer 21*a* of the first conductor layer 21. The through plating layer 51*b* may be integrated with a first plating layer 21*b* of the first conductor layer 21. The through conductor 51 may have a cross-sectional shape in the plane shown in FIG. 3 (the plane extending along the first direction and the third direction) that is an hourglass form, but is not limited thereto.

The first coil layers 21 and 31 may include the first insulating layer 31 disposed on one surface of the support member 15 and having a first pattern in a planar coil shape, and a first conductor layer 21 filling the first pattern of the first insulating layer 31 and including the first seed layer 21*a* and the first plating layer 21*b*. The third coil layers 23 and 33 may include the third insulating layer 33 disposed on the other surface of the support member 15 and having a third pattern in a planar coil shape, and a third conductor layer 23 filling the third pattern of the third insulating layer 33 and including the third seed layer 23*a* and the third plating layer 23*b*. The first seed layer 21*a* may be disposed at a lower portion in the first pattern of the first insulating layer 31. An end shape of the first seed layer 21*a* may have a flat shape. The first plating layer 21*b* may be disposed on the first seed layer 21*a* in the first pattern of the first insulating layer 31. The third seed layer 23*a* may be disposed at an upper portion in the third pattern of the third insulating layer 33. An end shape of the third seed layer 23*a* may have a flat shape. The third plating layer 23*b* may be disposed on the third seed layer 23*a* in the third pattern of the third insulating layer 33. As can be appreciated from the manufacturing process to be described below, the first and third seed layers 21*a* and 23*a* may first be formed, the first insulating layer 31 having the first pattern and the third insulating layer 33 having the third pattern may be formed accordingly, and then the first and third plating layers 21*b* and 23*b* may be formed by plating. As a result, the problem caused by the existing flash etching, or the like, may not occur, and the coil loss rate may be reduced to thereby lower electric resistance.

The first insulating layer 31 and the third insulating layer 33 may serve to selectively insulate the first conductor layer 21 and the third conductor layer 23. As long as a material of the first insulating layer 31 and the third insulating layer 33 includes an insulating material, any material may be applied. For example, a photo imageable dielectric (PID) resin, or the like, may be used. Meanwhile, the first insulating layer 31 and the third insulating layer 33 may include an insulating resin and a magnetic filler. In this case, resistance of an inter-layer magnetic field may be removed. An example of the insulating resin may include an epoxy resin. An example of the magnetic filler may include Fe alloys, amorphous alloys, ferrites, or the like. The first pattern and the third pattern formed on the first insulating layer 31 and the third insulating layer 33 may each include the planar coil shape. In this case, the turn numbers (or number of windings) of each coil may be at least 2, for example, about 3 to 5, but are not limited thereto.

The first seed layer 21*a* and the third seed layer 23*a* may each serve as a base metal layer for more easily plating the first plating layer 21*b* and the third plating layer 23*b*, respectively. As long as a formation material of the first seed layer 21*a* and the third seed layer 23*a* is a metal that may provide conductivity, any material may be applied without being particularly limited. For example, the formation material may include one or more selected from the group consisting of gold (Au), silver (Ag), platinum (Au), copper (Cu), nickel (Ni), palladium (Pd), alloys thereof, or the like. The first seed layer 21*a* and the third seed layer 23*a* may each be a single-layer structure. For example, the first seed layer 21*a* and the third seed layer 23*a* may each be a single-layer structure formed of copper (Cu), but are not limited thereto.

The first plating layer 21*b* and the third plating layer 23*b* may perform a substantial role of the first conductor layer 21 and the third conductor layer 23. The first plating layer 21*b* and the third plating layer 23*b* may be relatively thicker than the first seed layer 21*a* and the third seed layer 23*a*. As long as the first plating layer 21*b* and the third plating layer 23*b* are formed of metal that may provide conductivity, any metal may be applied without being particularly limited. For example, the formation material may include one or more selected from the group consisting of gold (Au), silver (Ag), platinum (Au), copper (Cu), nickel (Ni), palladium (Pd), an alloy thereof, or the like. The first plating layer 21*b* and the third plating layer 23*b* may each be a single-layer structure. For example, the first plating layer 21*b* and the third plating layer 23*b* may each be a single-layer structure formed of copper (Cu), but are not limited thereto.

The second coil layers 22 and 32 may include the second insulating layer 32 disposed on the first coil layers 21 and 31 and having a second pattern in a planar coil shape, and a second conductor layer 22 filling the second pattern of the second insulating layer 32 and including the second seed layer 22*a* and the second plating layer 22*b*. The fourth coil layers 24 and 34 may include the fourth insulating layer 34 disposed on the third coil layers 23 and 33 and having a fourth pattern in a planar coil shape, and a fourth conductor layer 24 filling the fourth pattern of the fourth insulating layer 34 and including the fourth seed layer 24*a* and the fourth plating layer 24*b*. The second seed layer 22*a* may be disposed at a lower portion and a side portion in the second pattern of the second insulating layer 32. The second seed layer 22*a* may have a shape in which an end surface thereof is bent (e.g., a 'U' shape). The second plating layer 22*b* may be disposed on the second seed layer 22*a* in the second pattern of the second insulating layer 32. The fourth seed layer 24*a* may be disposed at an upper portion and a side portion in the fourth pattern of the fourth insulating layer 34. The fourth seed layer 24*a* may have a shape in which an end surface thereof is bent (e.g., an inverted 'U' shape). The fourth plating layer 24*b* may be disposed on the fourth seed layer 24*a* in the fourth pattern of the fourth insulating layer 34. As can be appreciated from the manufacturing process to be described below, the second conductor layer 22 and the fourth conductor layer 24 may be formed by a so-called damascene process. As a result, the problem caused by the existing flash etching, or the like, may not occur, and the coil loss rate may be reduced to thereby lower electric resistance.

The second insulating layer 32 and the fourth insulating layer 34 may serve to selectively insulate the second conductor layer 22 and the fourth conductor layer 24. As long as a material of the second insulating layer 32 and the third insulating layer 33 includes an insulating material, any material may be applied. For example, the photo imageable dielectric (PID) resin, or the like, may be used. Meanwhile, the second insulating layer 32 and the fourth insulating layer 34 may include an insulating resin and a magnetic filler. In this case, resistance of an inter-layer magnetic field may be removed. An example of the magnetic filler may include Fe alloys, amorphous alloys, ferrites, or the like. The second pattern and the fourth pattern formed on the second insulating layer 32 and the fourth insulating layer 34 may each include the planar coil shape. In this case, the turn numbers (or number of windings) of each coil may be at least 2, for example, about 3 to 5, but are not limited thereto.

The second seed layer 22*a* and the fourth seed layer 24*a* may each serve as a base metal layer for more easily plating the second plating layer 22*b* and the fourth plating layer 24*b*, respectively. As long as a formation material of the second seed layer 22*a* and the fourth seed layer 24*a* is a metal that may provide conductivity, any material may be applied without being particularly limited. For example, the formation material may include one or more selected from the group consisting of gold (Au), silver (Ag), platinum (Au), copper (Cu), nickel (Ni), palladium (Pd), alloys thereof, or the like. The second seed layer 22*a* and the fourth seed layer 24*a* may each be a multilayer structure that includes a buffer seed layer including one or more selected from the group consisting of chromium (Cr), titanium (Ti), tantalum (Ta), palladium (Pd), nickel (Ni), alloys thereof, or the like, and a plating seed layer formed on the buffer seed layer and including one or more selected from the group consisting of gold (Au), silver (Ag), platinum (Pt), copper (Cu), nickel (Ni), palladium (Pd), alloys thereof, or the like. For example, the second seed layer 22*a* and the fourth seed layer 24*a* may each be a double-layer structure formed of titanium (Ti) and copper (Cu), but are not limited thereto.

The second plating layer 22*b* and the fourth plating layer 24*b* may perform a substantial role of the second conductor layer 22 and the fourth conductor layer 24. The second plating layer 22*b* and the fourth plating layer 24*b* may be relatively thicker (e.g., as measured in the third direction) than the second seed layer 22*a* and the fourth seed layer 24*a*. As long as the second plating layer 22*b* and the fourth plating layer 24*b* are formed of metal that may provide conductivity, any metal may be applied without being particularly limited. For example, the formation material may include one or more selected from the group consisting of gold (Au), silver (Ag), platinum (Au), copper (Cu), nickel (Ni), palladium (Pd), alloys thereof, or the like. The second plating layer 22*b* and the fourth plating layer 24*b* may each be a single-layer structure. For example, the second plating layer 22*b* and the fourth plating layer 24*b* may each be a single-layer structure formed of copper (Cu), but are not limited thereto.

The first insulating film 41 and the third insulating film 43 may respectively serve to insulate the first and second conductive layers 21 and 22 and the third and fourth conductor layers 23 and 24 that are disposed on different layers. As long as a material of the first insulating film 41 and the third insulating film 43 includes an insulating material, any material may be applied. As the insulating material, a thermosetting resin such as an epoxy resin, a thermoplastic resin such as polyimide, a resin formed by impregnating a reinforcing material such as a glass fiber or an inorganic filler in the thermosetting resin and the thermoplastic resin, for example, xBF commercialized in the market, or the like, may be used.

The second insulating film 42 and the fourth insulating film 44 may respectively be disposed on the second coil layers 22 and 32 and the fourth coil layers 24 and 34 to insulate the second coil layers 22 and 32 and the fourth coil layers 24 and 34 from other components and protect the second coil layers 22 and 32 and the fourth coil layers 24 and 34. As long as a material of the second insulating film 42 and the fourth insulating film 44 includes an insulating material, any material may be applied. As the insulating material, a thermosetting resin such as an epoxy resin, a thermoplastic resin such as polyimide, a resin formed by impregnating a reinforcing material such as a glass fiber or an inorganic filler in the thermosetting resin and the thermoplastic resin, for example, xBF commercialized in the market, or the like, may be used.

The first via 61 and the second via 62 may respectively electrically connect the first and second conductive layers 21 and 22 and the third and fourth conductor layers 23 and 24 that are disposed on different layers. The first via 61 may include a first via seed layer 61*a* and a first via plating layer 61*b*. The second via 62 may include a second via seed layer 62*a* and a second via plating layer 62*b*. Similar to the second seed layer 22*a*, the first via seed layer 61*a* may be disposed at a lower portion and a side portion of a via pattern formed on the first insulating film 41. The first via seed layer 61*a* may be integrated with the second seed layer 22*a*. Similar to the fourth seed layer 24*a*, the second via seed layer 62*a* may be disposed at an upper portion and a side portion of a via pattern formed on the third insulating film 43. The second via seed layer 62*a* may be integrated with the fourth seed layer 24*a*. The first via plating layer 61*b* may be integrated with the second plating layer 22*b*. The second via plating layer 62*b* may be integrated with the fourth plating layer 24*b*.

The first to fourth coil layers 21, 31, 22, 32, 23, 33, 24, and 34 may be electrically connected (e.g., series connected) to each other to form one coil. An end portion of the second coil layer 22 may be connected to the first electrode 81. An end portion of the fourth coil layer 24 may be connected to the second electrode 82. The coil part 20 may have the turn number (or number of windings) increased in a horizontal direction (e.g., by increasing the number of windings of coil layers 21, 22, 23, and 24), and the turn number (or number of windings) increased in a vertical direction (e.g., by increasing the number of stacked coils), thereby easily implementing high inductance. The coil component 100A according to one example of the structure may be, for example, a power inductor, but is not limited thereto.

Meanwhile, FIG. 3 shows that the coil layer may be disposed on both surfaces (e.g., two opposing main surfaces) of the support member 15. However, if necessary, the coil layer may be disposed only on one surface of the support member 15. Further, FIG. 3 shows that the coil layer may include two layers disposed on each of the two opposing surfaces of the support member 15. However, if necessary, the coil layer may include two or more layers disposed on each surface of the support member 15. In this case, the contents and characteristics of the second coil layers 22 and 32 and/or the fourth coil layers 24 and 34 may be applied to the additional coil layer(s) (e.g., to the third, fourth, and subsequent coil layers).

As shown in FIG. 3, a central portion 18 of the coil part 20 may also be filled with a magnetic material, but is not limited thereto, and therefore may not be filled with a magnetic material.

Figure 4A:
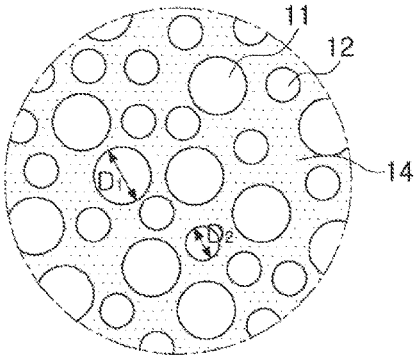
FIGS. 4A and 4B are schematic enlarged cross-sectional views of a region Q of the coil component of FIG. 3.
Figure 4B:
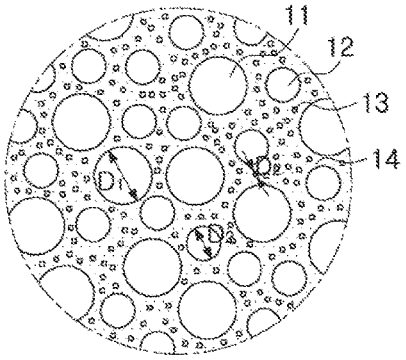

FIGS. 4A and 4B are schematic enlarged cross-sectional views of a region Q of the coil component of FIG. 3. Referring to FIGS. 4A and 4B, the magnetic material covering the coil part 20 may be made of a magnetic resin composite in which magnetic metal powders 11, 12, and 13 and a resin mixture 14 are mixed. The magnetic metal powders 11, 12, and 13 may include iron (Fe), chromium (Cr), or silicon (Si) as main components and may include, for example, Fe—Ni, Fe, Fe—Cr—Si, or the like. The resin mixture 14 may include epoxy, polyimide, liquid crystal polymer (LCP), or the like. The magnetic metal powders 11, 12, and 13 may be magnetic metal powders 11, 12, and 13 having at least two particle sizes D1, D2, and D3. For example, FIG. 4A shows the region Q as including magnetic metal powders 11 and 12 having two particle sizes D1 and D2, while FIG. 4B shows the region Q as including magnetic metal powders 11, 12, and 13 having three particle sizes D1, D2, and D3. In this case, a bimodal magnetic metal material having different sizes may be compressed to fill up the magnetic resin composite, thereby increasing a filling rate.

FIGS. 5A through 5F are diagrams showing sequential steps of an illustrative manufacturing process of the coil component of FIG. 2. Hereinafter, a description overlapping the foregoing contents will be omitted, and each step of the schematic manufacturing process of the coil component will be described.

Figure 5A:
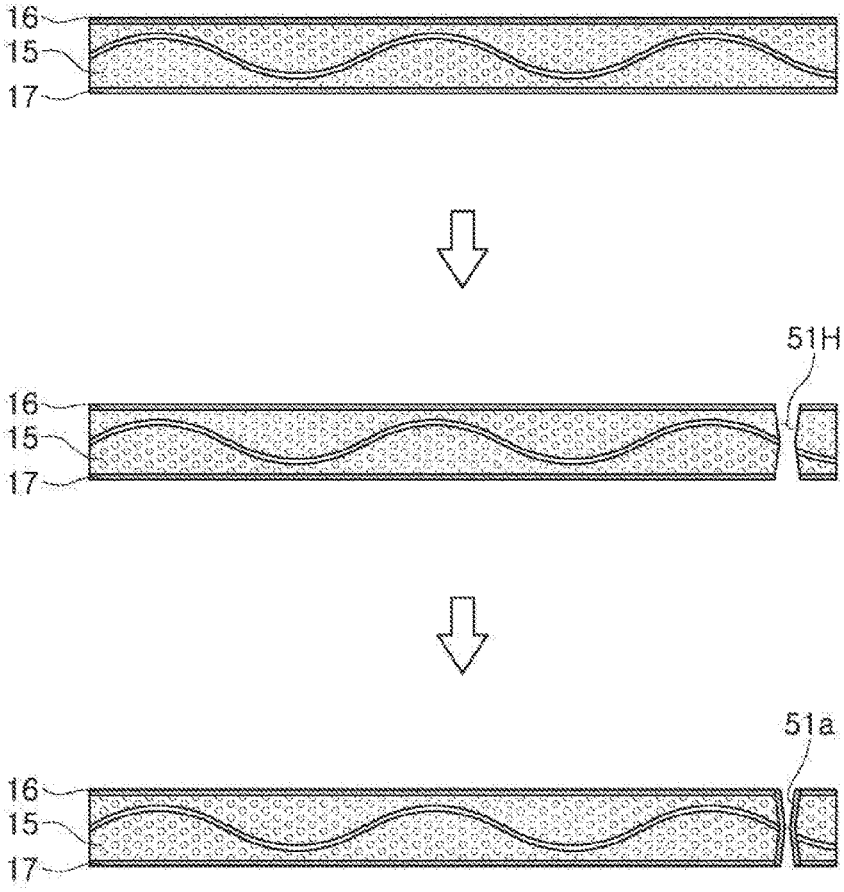
FIGS. 5A through 5F are diagrams showing sequential steps of an illustrative manufacturing process of the coil component of FIG. 2.

Referring to FIG. 5A, the support member 15 having both opposing main surfaces on which the metal layers 16 and 17 are disposed may be prepared. Next, a through hole 51H penetrating through the support member 51 may be formed. The through hole 51H may also be formed using a mechanical drill and/or a laser drill, a sand blasting method using a polishing particle, a dry etching method using plasma, or the like. When the through hole 51H is formed by the mechanical drill and/or the laser drill, resin smear in the through hole 51H may be removed by performing de-smear processing such as by using a permanganate method. Next, a side portion of the through hole 51H may be provided with a through seed layer 51*a*. The through seed layer 51*a* may be applied with a sputtering method, a spin method, chemical copper, or the like.

Figure 5B:
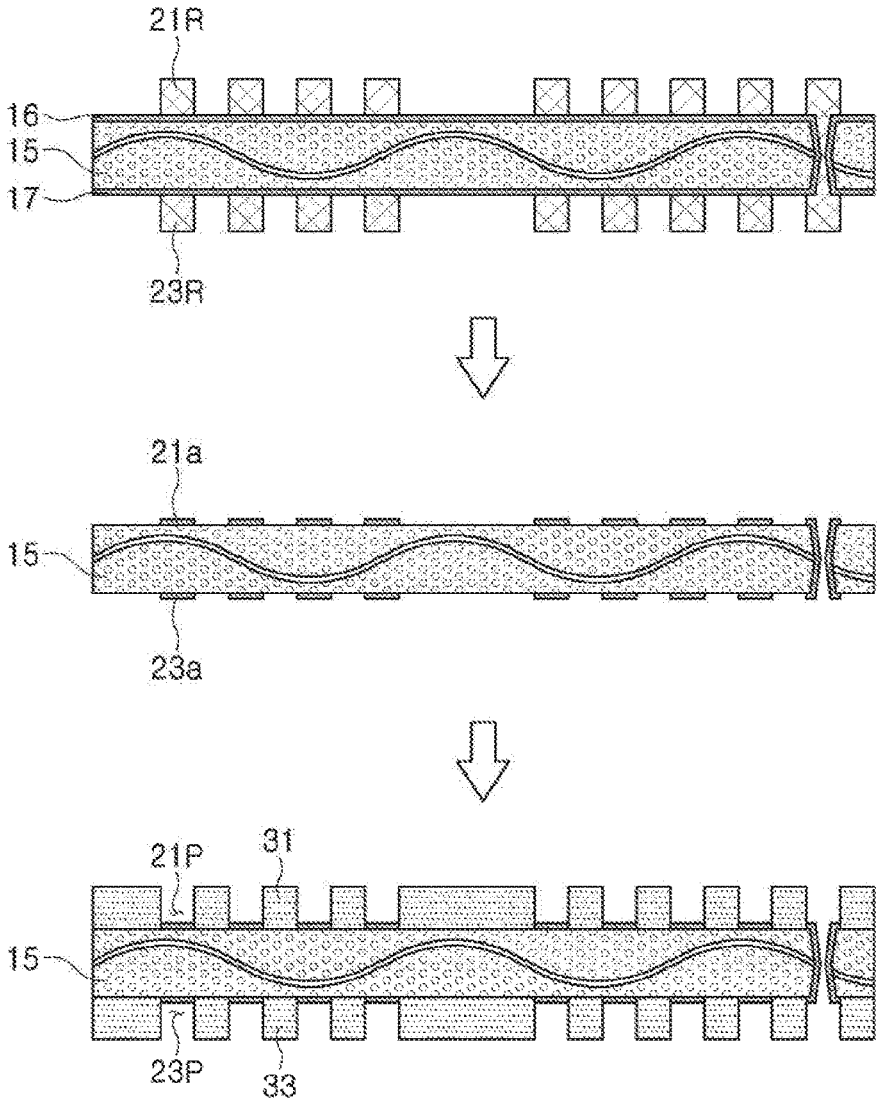

Referring to FIG. 5B, the metal layers 16 and 17 may be patterned using a photolithography method to have a planar coil shape. Specifically, a photoresist may be applied on each metal layer 16 and 17, and the photoresist may be patterned in the planar coil shape to form the photolithography masks 21R and 23R. The masks 21R and 23R are then used to form the metal patterns 21*a* and 23*a* in the metal layers 16 and 17. The patterned metal layers 16 and 17 may thus respectively be used to form the first seed layer 21*a* and the third seed layer 23*a*. Next, the first insulating layer 31 having the first pattern in the planar coil shape and the third insulating layer 33 having the third pattern in the planar coil shape may be formed on both surfaces of the support member 15 by the photolithography method. As such, the insulating layer and the pattern may be formed simultaneously, and as a result the number of processes may be reduced. The first insulating layer 31 and the third insulating layer 33 may be formed to have a thickness measured from the respective surface of the support member 15 that is larger than a thickness of the first and third seed layers 21*a* and 23*a*, such that gaps 21P and 23P are formed in the first and third insulating layers 31 and 33 at locations of the first and third seed layers 21*a* and 23*a*.

Figure 5C:
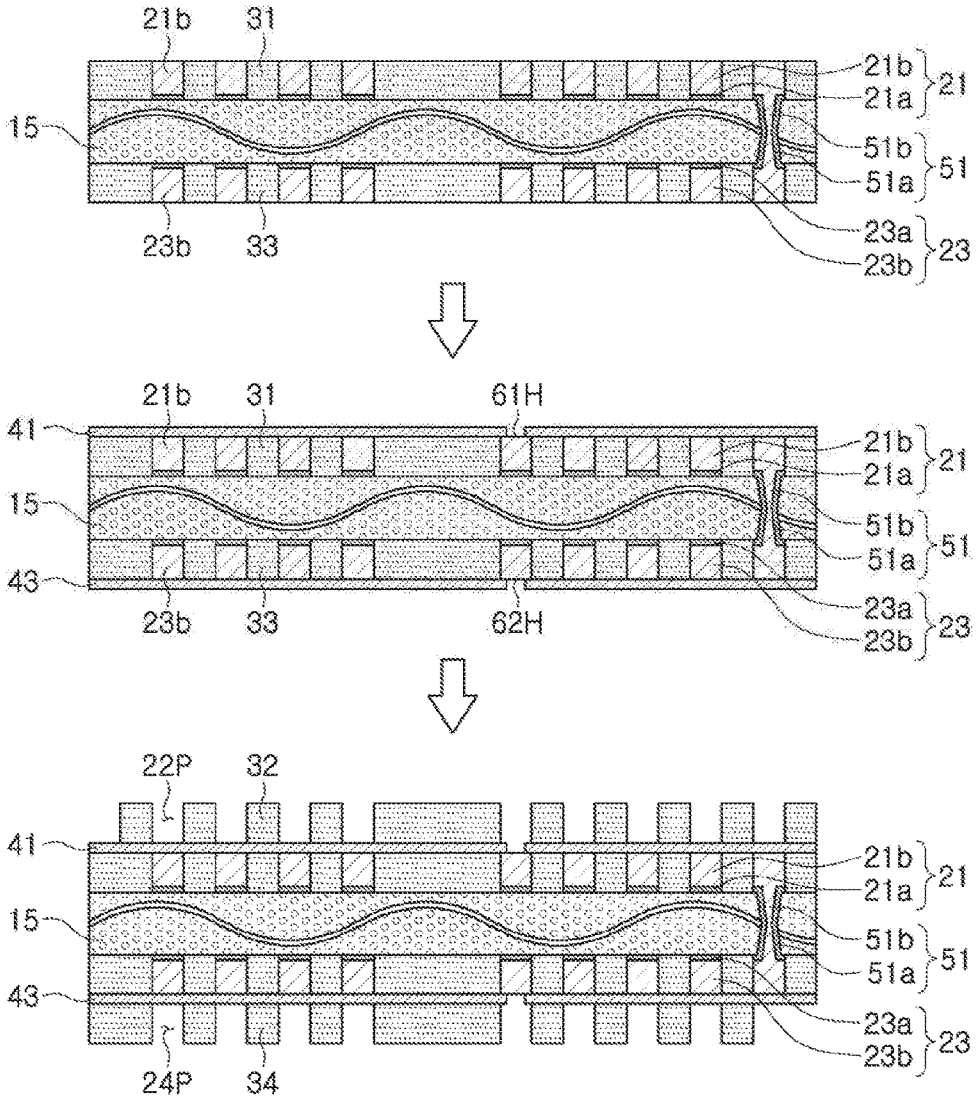

Referring to FIG. 5C, based on the first seed layer 21*a* and the third seed layer 23*a*, the first plating layer 21*b* and the third plating layer 23*b* may be formed by an electroless plating method using a dry film, an electrolytic plating method, or the like. In this case, the through plating layer 51*b* may also be formed together with the first and third plating layers 21*b* and 23*b*. As a result, the first conductor layer 21 and the third conductor layer 23 corresponding to the inside conductor layer may be formed. Further, the through conductor 51 connecting the first conductor layer 21 and the third conductor layer 23 may be formed. As such, since the coil pattern is formed in the insulating layer, as in the related art, the flash etching may be unnecessary, and thus the coil loss rate may be reduced to secure the low resistance. Next, the first insulating film 41 and the third insulating film 43 may be stacked on the first coil layers 21 and 31 and the third coil layers 23 and 33, respectively. This may be performed using a lamination method. Next, a first via hole 61H and a second via hole 62H may be formed in the first insulating film 41 and the third insulating film 43 by the mechanical drill and/or the laser drill, or the like. Next, the second insulating layer 32 having the second pattern in the planar coil shape and the fourth insulating layer 34 having the fourth pattern in the planar coil shape may be formed on the first insulating film 41 and the third insulating film 43, respectively, by the photolithography method. As such, the insulating layer and the pattern may be formed simultaneously, and as a result the number of processes may be reduced. As formed, the second and fourth insulating layers 32 and 34 have gaps 22P and 24P formed therein according to the formed pattern.

Figure 5D:
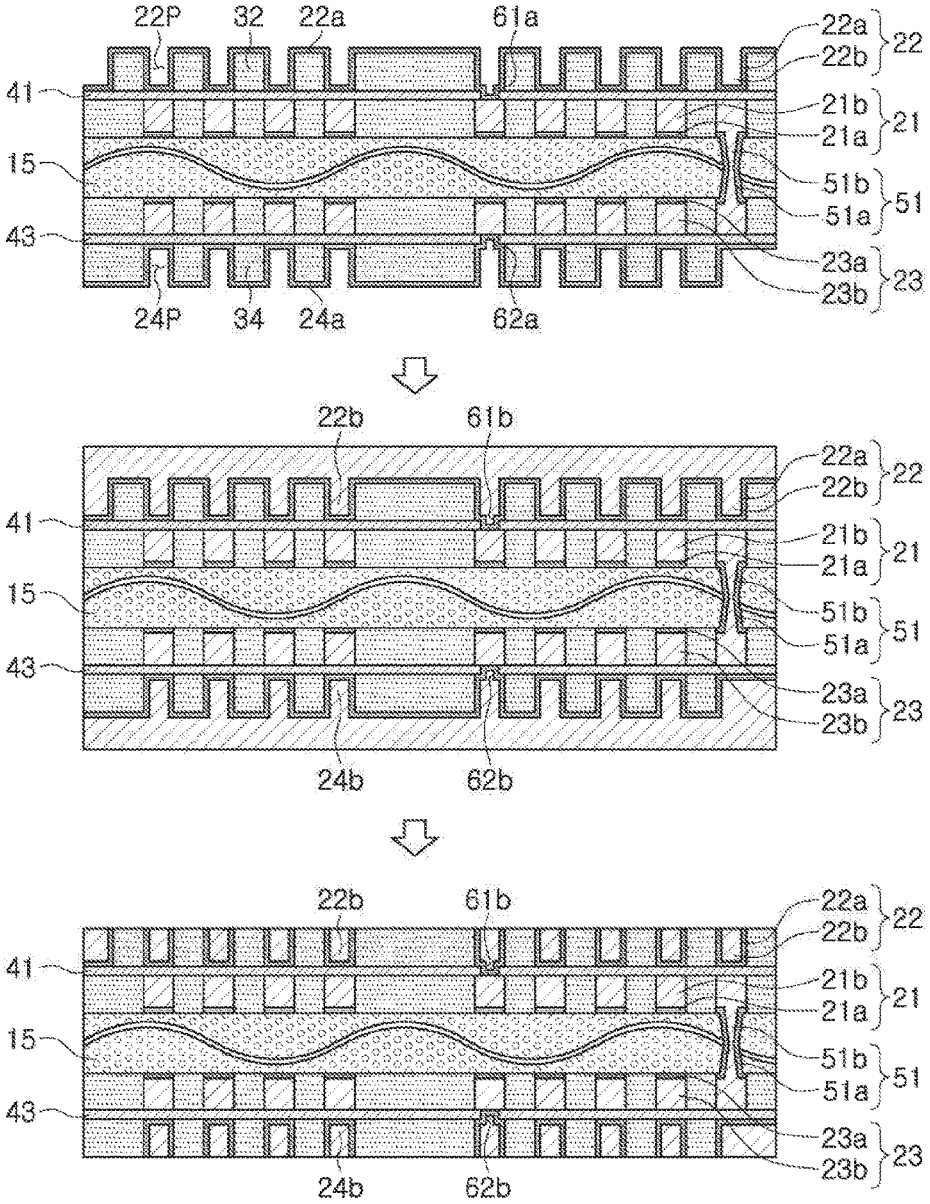

Referring to FIG. 5D, the second seed layer 22*a* may be formed on the surface of the second insulating layer 32, the surface of the first insulating film 41 exposed in gaps 22P in the second insulating layer 32, and the wall surface of the gaps 22P of the second insulating layer 32 by the sputtering method, the spin method, the chemical copper, or the like. In this case, the first via seed layer 61*a* may be formed together with the forming of the second seed layer 22*a*. Further, the fourth seed layer 24*a* may be formed on the surface of the fourth insulating layer 34, the surface of the third insulating film 43 exposed in gaps 24P in the fourth insulating layer 34, and the wall surface of the gaps 24P of the fourth insulating layer 34 by the sputtering method, the spin method, the chemical copper, or the like. In this case, the second via seed layer 62*a* may be formed together with the forming of the fourth seed layer 24*a*. Next, the second plating layer 22*b* and the fourth plating layer 24*b* may be formed by front plating. In this case, the first via plating layer 61*b* and the second via plating layer 61*b* may also be formed together with the forming of the second and fourth plating layers 22*b* and 24*b*. Here, the so-called damascene method using the front plating and planarization may be used. The planarization method may not particularly be limited, and other methods such as chemical mechanical polishing (CMP), lapping polishing, or the like may be applied. The coil pattern having a constant shape may be implemented by surface planarization. As a result, the second conductor layer 22 and the fourth conductor layer 24 corresponding to the outside conductor layer may be formed. Further, the first via 61 and the second via 62 connecting the second conductor layer 22 and the fourth conductor layer 24 to the inside conductor layer may be formed.

Figure 5E:
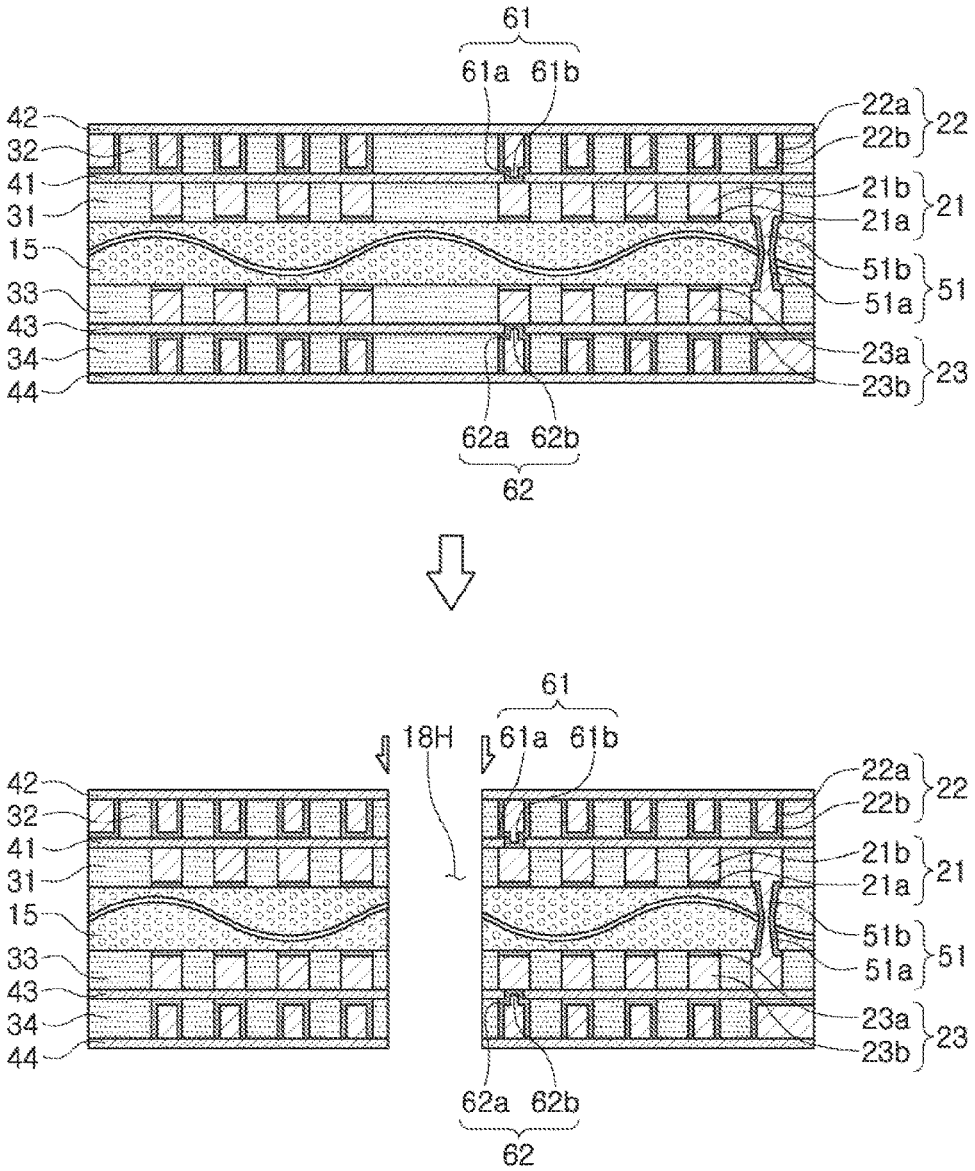

Referring to FIG. 5E, the second insulating film 42 and the fourth insulating film 44 may be stacked on the second coil layers 22 and 32 and on the fourth coil layers 24 and 34, respectively. As a result, the coil part 20 may be formed. As such, the coil layer may be simultaneously formed on both surfaces of the support member 15, and as a result productivity may be improved. After the coil part 20 is formed, if necessary, a core hole 18H penetrating through the central portion of the coil part 20 may be formed. The core hole 18H may be filled with the magnetic material (e.g., numeral 18 in FIG. 5F). In this case, the magnetic characteristics of the coil part 20 may be improved when the core hole 18H is filled with magnetic material.

Figure 5F:
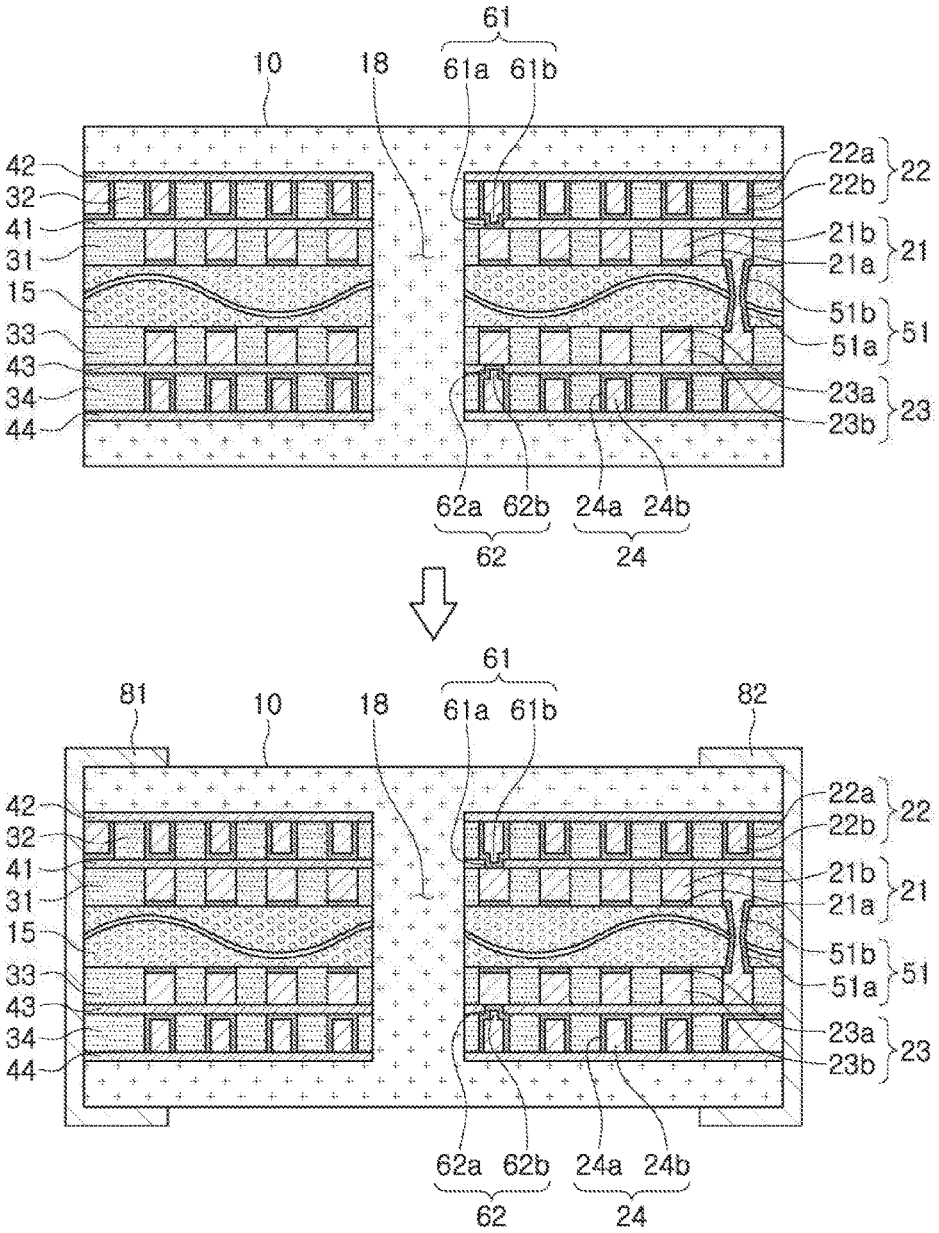

Referring to FIG. 5F, magnetic sheets may be stacked on the second insulating film 42 and the fourth insulating film 44, respectively. Lamination methods may be applied for the stacking of the magnetic sheets. As a result, the body 10 may be completed. Next, the first electrode 81 and the second electrode 82 may be formed on the body 10. The first electrode 81 and the second electrode 82 may be formed of a paste including metal having excellent conductivity, and the conductor layer may be further formed on the paste layer. As a result, the coil component 100A may be manufactured.

For convenience, FIGS. 5A through 5F show manufacturing of one coil component 10, but in the actual mass production process, the coil component may be manufactured by a method of simultaneously forming a plurality of coil components on one large substrate and then individually cutting the coil components.

Figure 6:
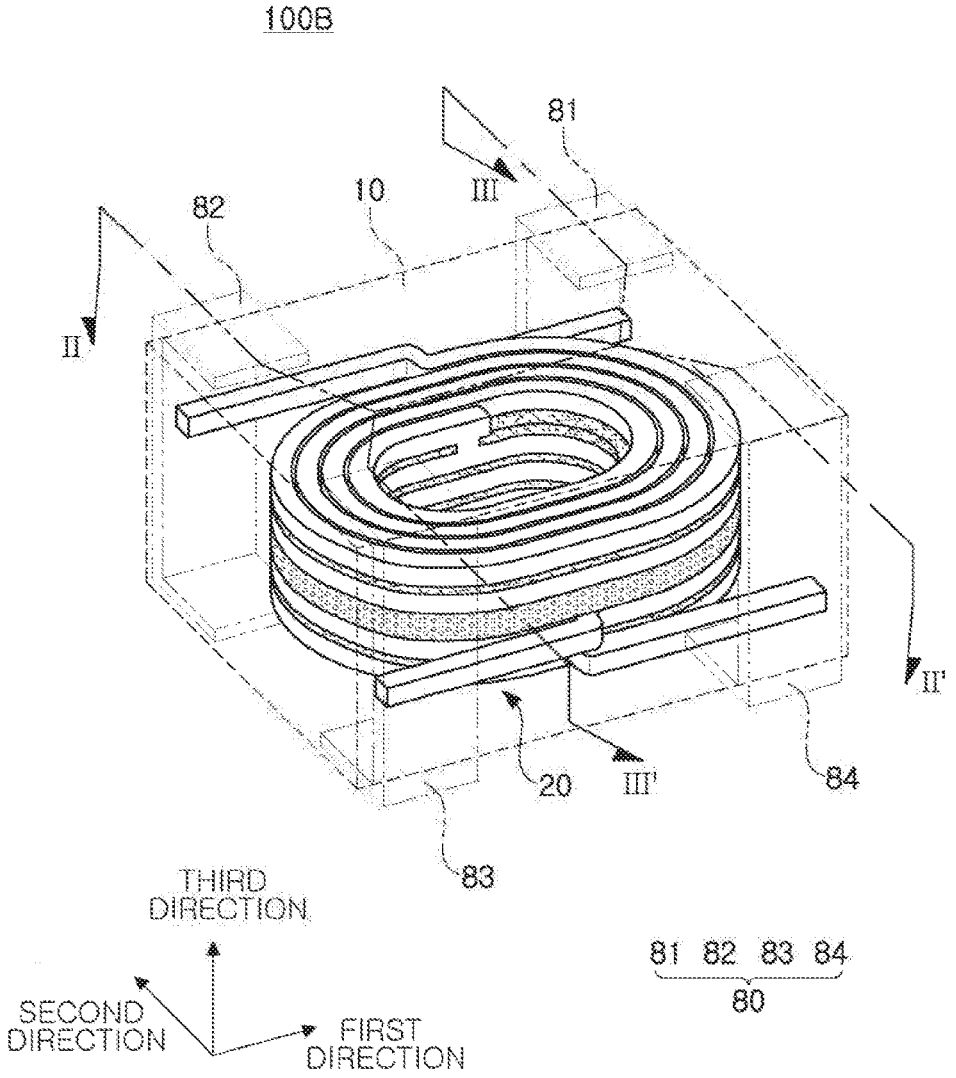
FIG. 6 is a perspective view schematically showing another example of the coil component.

FIG. 6 is a perspective view schematically illustrating another example of the coil component. Referring to FIG. 6, a coil component 100B according to another exemplary embodiment may include the body 10 and the one or more electrode(s) 80 disposed on the body 10. A coil part 20 may be disposed in the body 10. The coil part 20 disposed in the body 10 may be covered with or encased within a magnetic material. The one or more electrode(s) 80 may include the first to fourth electrodes 81, 82, 83, and 84 that are disposed on the body 10 to be spaced apart from each other. The first to fourth electrodes 81, 82, 83, and 84 may each be connected to a different respective terminal of the coil part 20. The other detailed contents are the same as the foregoing description and will therefore be omitted.

Figure 7:
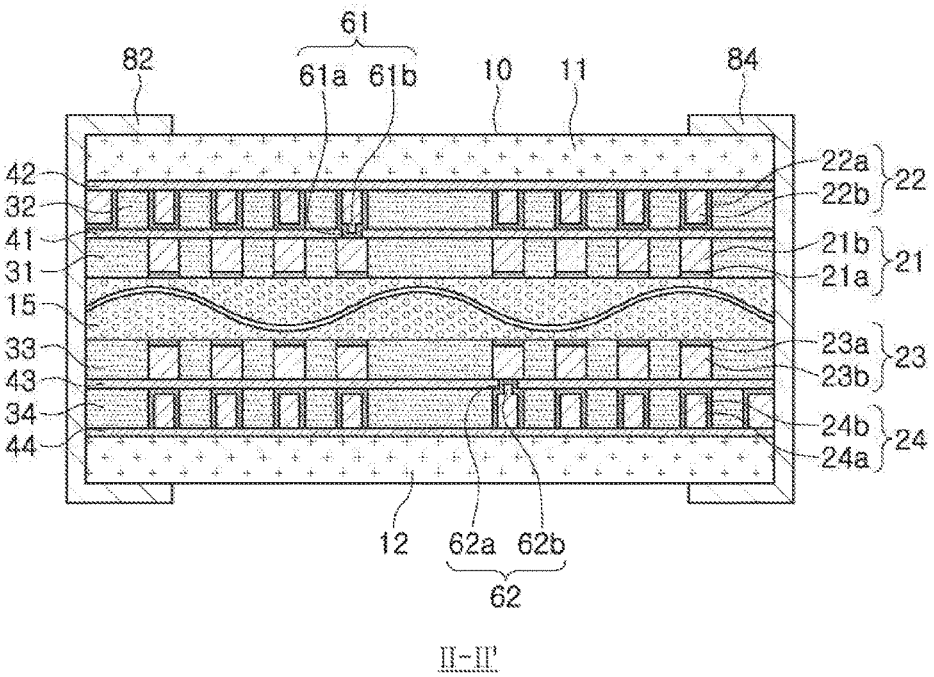
FIG. 7 is a schematic cross-sectional cut view of the coil component of FIG. 6 taken along II-II'.
Figure 8:
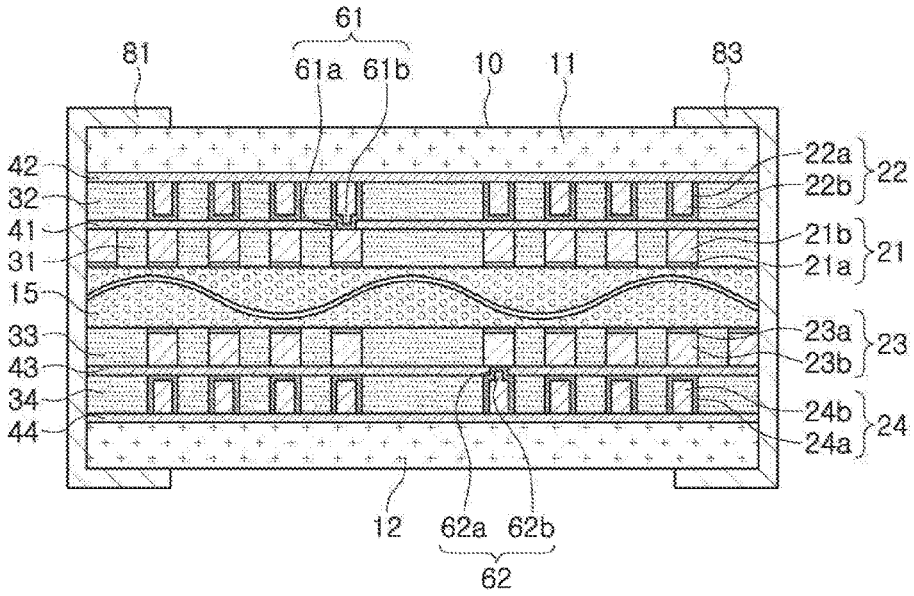
FIG. 8 is a schematic cross-sectional cut view of the coil component of FIG. 6 taken along III-III'.

FIG. 7 is a schematic cross-sectional cut view of the coil component of FIG. 6 taken along FIG. 8 is a schematic cross-sectional cut view of the coil component of FIG. 6 taken along III-III'. Referring to FIGS. 7 and 8, the coil part 20 may include a support member 15, first coil layers 21 and 31 disposed on one surface of the support member 15, second coil layers 22 and 32 disposed on the first coil layers 21 and 31, a first insulating film 41 disposed between the first coil layers 21 and 31 and the second coil layers 22 and 32, a first via 61 penetrating through the first insulating film 41 and connecting between the first coil layers 21 and 31 and the second coil layers 22 and 32, and a second insulating film 42 disposed on the second coil layers 22 and 32. Further, the coil part 20 may include third coil layers 23 and 33 disposed on an opposite surface (the other surface) of the one surface of the support member 15, fourth coil layers 24 and 34 disposed on third coil layers 23 and 33, a third insulating film 43 disposed between the third coil layers 23 and 33 and the fourth coil layers 24 and 34, a second via 62 penetrating through the third insulating film 43 and connecting between the third coil layers 23 and 33 and the fourth coil layers 24 and 34, and a fourth insulating film 44 disposed on the fourth coil layers 24 and 34. Hereinafter, each component will be described, but overlapping contents with the foregoing contents will be omitted.

The first and second coil layers 21, 31, 22, and 32 may be electrically connected to each other to form a first coil. The third and fourth coil layers 23, 33, 24, and 34 may be electrically connected to each other to form a second coil. The end portions of the first coil layers 21 and 31 may be connected to the first electrode 81. The end portions of the second coil layers 22 and 32 may be connected to the second electrode 82. The end portions of the third coil layers 23 and 33 may be connected to the third electrode 83. The end portions of the fourth coil layers 24 and 34 may be connected to the fourth electrode 84. If a current flows between the first coil and the second coil in the same direction, a magnetic flux may be supplemented with each other to increase the common mode impedance, thereby suppressing the common mode noise. On the other hand, if a current flows between the first coil and the second coil in an opposite direction, the magnetic flux may be offset from each other to reduce the differential mode impedance, thereby passing the wanted transmission signal. The coil component 100B according to another example of the structure may be, for example, a common mode filter, but is not limited thereto.

Meanwhile, FIGS. 7 and 8 show that the coil layers may be disposed on both surfaces of the support member 15. However, if necessary, the coil layer may be disposed only on one surface of the support member 15. Further, FIGS. 7 and 8 show that two coil layers may be disposed on each surface of the support member 15. However, if necessary, more than two coil layers may be disposed on one or both surfaces of the support member 15. In this case, the additional coil layers may have the same contents as the second coil layers 22 and 32 and/or the fourth coil layers 24 and 34.

As shown in FIGS. 7 and 8, a sheet type of first magnetic material 11 and a sheet type of second magnetic material 12 may respectively be stacked on the upper portion and the lower portion of the coil part 20. In this case, the electrode(s) 80 may be formed to extend to both the upper portion and the lower portion of the body 10 and therefore may not have any limit in the mounting direction. Therefore, the mounting of the electrode(s) 80 is not limited thereto.

FIGS. 9A through 9E are diagrams showing sequential steps of an illustrative manufacturing process of the coil component of FIG. 6. Hereinafter, a description overlapping the foregoing contents will be omitted and each step of the schematic manufacturing process of the coil component will be described.

Figure 9A:
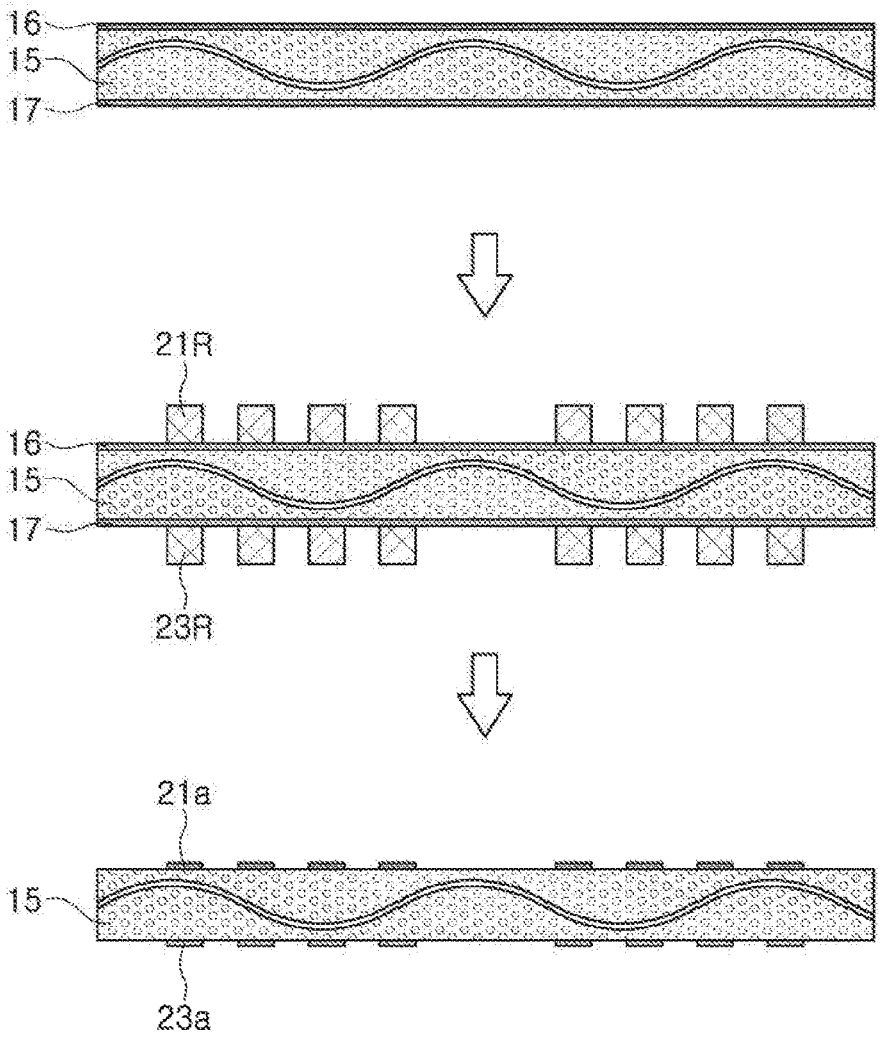
FIGS. 9A through 9E are diagrams showing sequential steps of an illustrative manufacturing process of the coil component of FIG. 6.

Referring to FIG. 9A, the support member 15 having both opposing main surfaces on which the metal layers 16 and 17 are disposed may be prepared. Next, the metal layers 16 and 17 may be patterned to have the planar coil shape. Specifically, a photoresist may be applied on each metal layer 16 and 17, and the photoresist may be patterned in the planar coil shape to form the photolithography masks 21R and 23R. The masks 21R and 23R are then used to form the metal patterns 21*a* and 23*a* in the metal layers 16 and 17. The patterned metal layers 16 and 17 may thus respectively be used to form the first seed layer 21*a* of the first plating layer 21*b* and the third seed layer 23*a* of the third plating layer 23*b*.

Figure 9B:
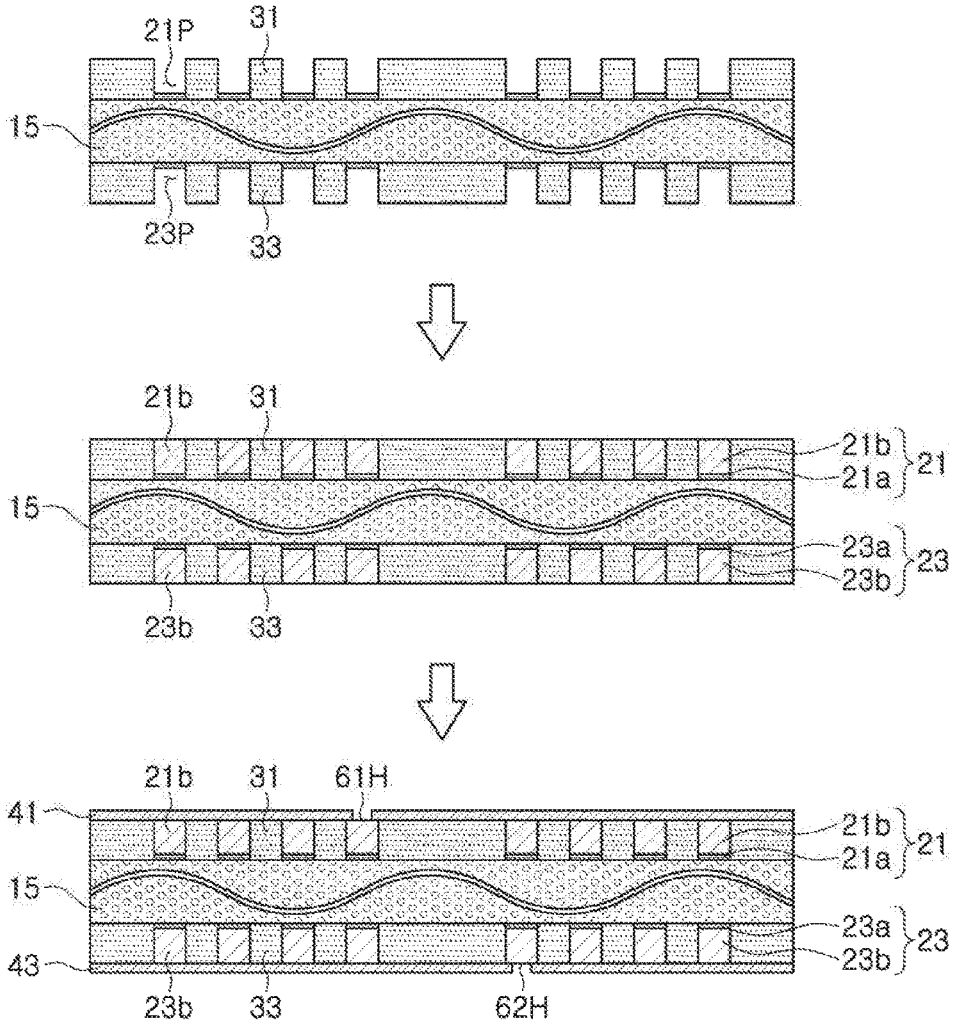

Referring to FIG. 9B, the first insulating layer 31 having the first pattern in the planar coil shape and the third insulating layer 33 having the third pattern in the planar coil shape may be formed on both surfaces of the support member 15. The first insulating layer 31 and the third insulating layer 33 may be formed to have a thickness measured from the respective surface of the support member 15 that is larger than a thickness of the first and third seed layers 21*a* and 23*a*, such that gaps 21P and 23P are formed in the first and third insulating layers 31 and 33 at locations of the first and third seed layers 21*a* and 23*a*. Next, the first plating layer 21*b* and the third plating layer 23*b* may be formed in the gaps 21P and 23P based on the first seed layer 21*a* and the third seed layer 23*a*. As a result, the first conductor layer 21 and the third conductor layer 23 corresponding to the inside conductor layer may be formed. Next, the first insulating film 41 and the third insulating film 43 may be stacked on the first coil layers 21 and 31 and the third coil layers 23 and 33, respectively. Next, the first via hole 61H and the second via hole 62H may be formed in the first insulating film 41 and the second insulating film 42 using the mechanical drill and/or the laser drill, or the like.

Figure 9C:
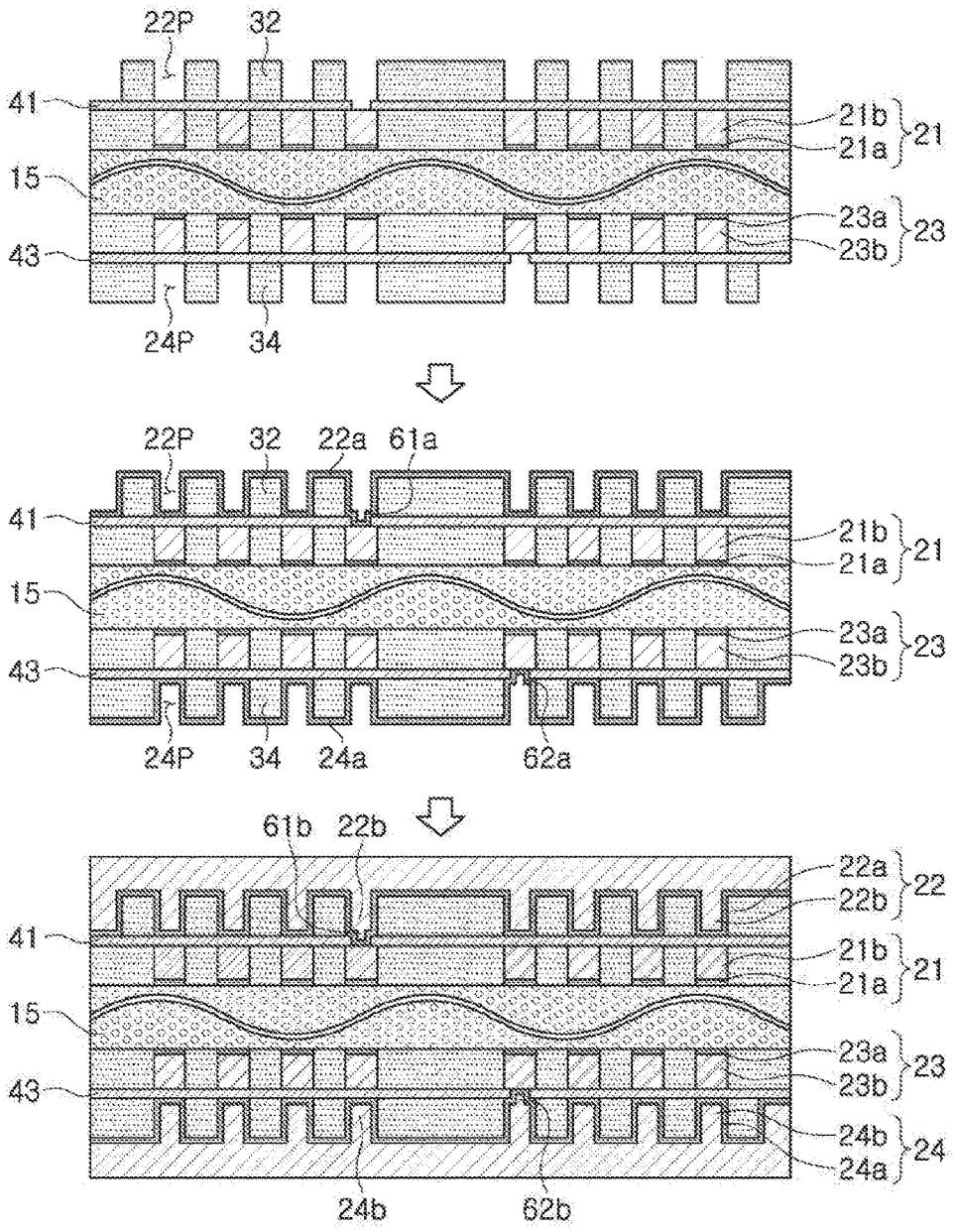

Referring to FIG. 9C, the second insulating layer 32 having the second pattern in the planar coil shape and the fourth insulating layer 34 having the fourth pattern in the planar coil shape may be formed on the first insulating film 41 and the third insulating film 43, respectively. The second insulating layer 32 and the fourth insulating layer 34 may be formed to have gaps 22P and 24P therein at locations of the second and fourth patterns. Next, the second seed layer 22*a* may be formed on the surface of the second insulating layer 32, the surface of the first insulating film 41 exposed in gaps 22P in a second pattern of the second insulating layer 32, and the wall surface of the gaps 22P of the second insulating layer 32. In this case, the first via seed layer 61*a* may be formed together with the forming of the second seed layer 22*a*. Further, the fourth seed layer 24*a* may be formed on the surface of the fourth insulating layer 34, the surface of the second insulating film 42 exposed in gaps 24P in a fourth pattern of the fourth insulating layer 34, and the wall surface of the gaps 24*p* of the fourth insulating layer 34. In this case, the second via seed layer 62*a* may be formed together with the forming of the fourth seed layer 24*a*. Next, the second plating layer 22*b* and the fourth plating layer 24*b* may be formed by front plating. In this case, the first via plating layer 61*b* and the second via plating layer 61*b* may also be formed together with the forming of the second and fourth plating layers 22*b* and 24*b*.

Figure 9D:
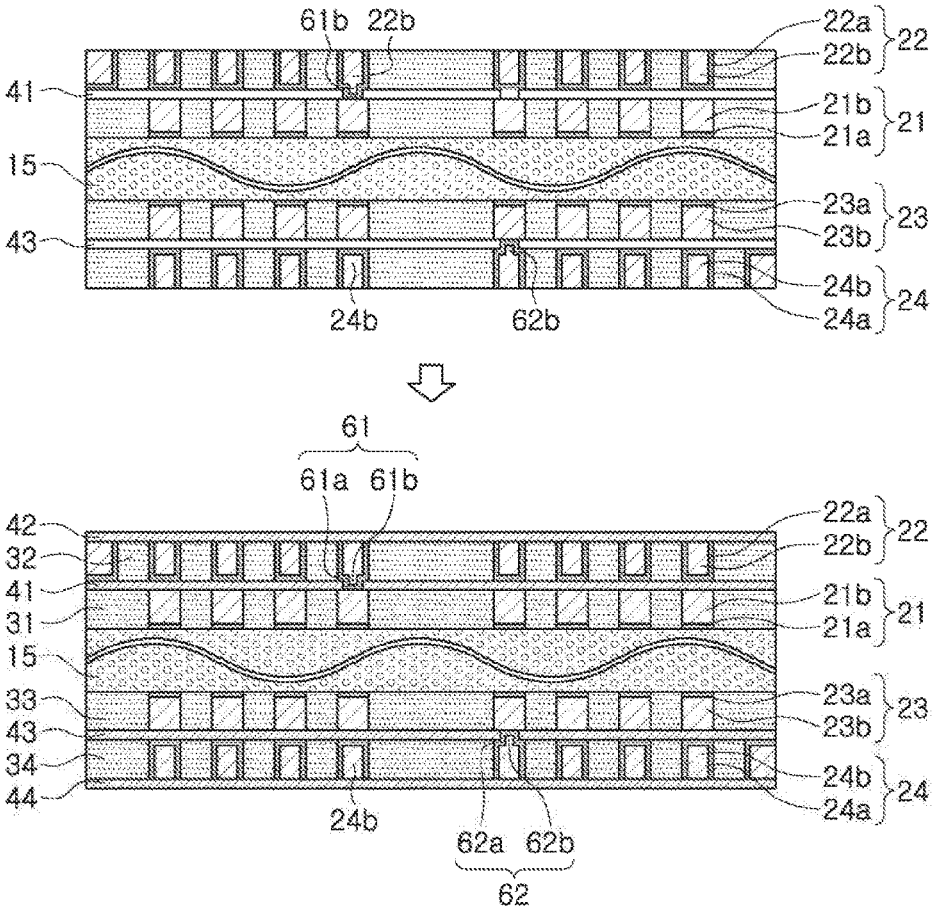

Referring to FIG. 9D, the upper portions of the second plating layer 22 and the second insulating layer 32 and the lower portions of the fourth plating layer 24 and the fourth insulating layer 34 may be planarized. As a result, the second conductor layer 22 and the fourth conductor layer 24 corresponding to the outside conductor layer may be formed. Further, the first via 61 and the second via 62 connecting the second conductor layer 22 and the fourth conductor layer 24 to the inside conductor layer may be formed. Next, the second insulating film 42 and the fourth insulating film 44 may be stacked on the second coil layers 22 and 32 and on the fourth coil layers 24 and 34, respectively. As a result, the coil part 20 may be formed.

Figure 9E:
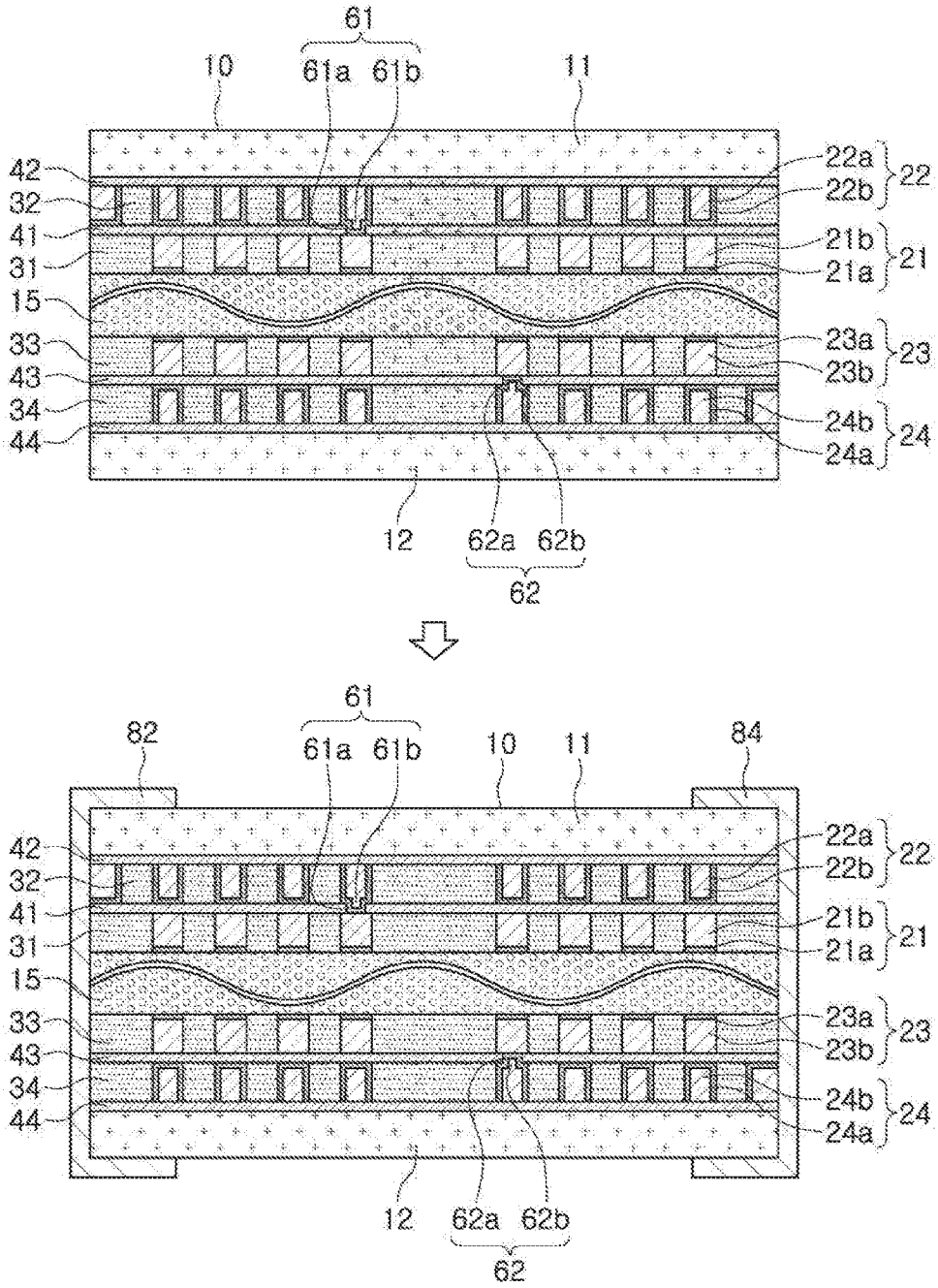

Referring to FIG. 9E, the first magnetic sheet 11 and the second magnetic sheet 12 may be stacked on the second insulating film 42 and the fourth insulating film 44, respectively. As a result, the body 10 may be completed. Next, the first electrode 81 and the second electrode 82 may be formed on the body 10. Further, the third and fourth electrodes 83 and 84 may be formed on the body 10. As a result, the coil component 100B may be manufactured.

As set forth above, according to the exemplary embodiments described herein, it is possible to provide the coil component and the method of effectively manufacturing the same capable of increasing productivity, reducing the coil loss rate to secure low resistance, and improving the resolution of the micro line width.

Meanwhile, in the present disclosure, a word "electrically connected" is a concept including both a case in which any component is physically connected to another component and a case in which any component is not physically connected to another component. Also, terms "first", "second", and the like, are used to distinguish one component from another component, and do not limit a sequence, importance, and the like, of the corresponding components. In some cases, a first component may be named a second component and a second component may also be similarly named a first component, without departing from the scope of the disclosure.

Meanwhile, a term "example" used in the present disclosure does not mean the same exemplary embodiment, but is provided in order to emphasize and describe different unique features. As a result, the above suggested examples may also be combined with one or more feature (s) of other examples. For example, even though particulars described in a specific example are not described in another example, it may be understood that the particulars can be incorporated into the other example unless described otherwise.

While exemplary embodiments have been shown and described above, it will be apparent to those skilled in the art that modifications and variations could be made without departing from the spirit and scope of the disclosure as defined by the appended claims.

What is claimed is:

1. A coil component, comprising:

a coil part including a support member, a first coil layer disposed on one surface of the support member, and a second coil layer disposed on the first coil layer;

a body including a magnetic material covering the coil part; and an electrode disposed on the body and connected to the coil part, wherein the first and second coil layers each includes an insulating layer having a pattern in a planar coil shape and a conductor layer disposed in the pattern and including a seed layer and a plating layer, and seed layers of the first and second coil layers have different cross sectional shapes such that the seed layer of the first coil layer is planar and extends on only a lower surface from among lower and side surfaces of the plating layer of the first coil layer, and the seed layer of the second coil layer extends on a lower surface and side surfaces of the plating layer of the second coil layer disposed on the first coil layer having the planar seed layer.

2. The coil component of claim 1, wherein the seed layer of the first coil layer has a flat cross sectional shape, and the seed layer of the second coil layer has a bent cross sectional shape.

3. The coil component of claim 1, wherein the coil part further includes:

a first insulating film disposed between the first and second coil layers;

a second insulating film disposed on the second coil layer; and a first via penetrating through the first insulating film and electrically connecting the first and second coil layers.

4. The coil component of claim 1, wherein the coil part further includes a third coil layer disposed on another surface of the support member opposite to the one surface, and a fourth coil layer disposed on the third coil layer, wherein the third and fourth coil layers each include an insulating layer having a pattern in a planar coil shape and a conductor layer filling the pattern and including a seed layer and a plating layer, and seed layers of the third and fourth coil layers are disposed differently in the conductor layers of the third and fourth coil layers.

5. The coil component of claim 4, wherein the seed layer of the third coil layer is disposed on one first side of the conductor layer of the third coil layer, and the seed layer of the fourth coil layer is disposed on the one first side of the conductor layer of the fourth coil layer and on a second side of the conductor layer of the fourth coil layer perpendicular to the first side.

6. The coil component of claim 4, wherein the seed layers of the third and fourth coil layers have different cross sectional shapes.

7. The coil component of claim 6, wherein the seed layer of the third coil layer has a flat cross sectional shape to extend on only a lower surface from among lower and side surfaces of the plating layer of the third coil layer, and the seed layer of the fourth coil layer has a bent cross sectional shape to extend on a lower surface and side surfaces of the plating layer of the fourth coil layer disposed on the third coil layer having the flat seed layer.

8. The coil component of claim 4, wherein the coil part further includes:

a third insulating film disposed between the third and fourth coil layers;

a fourth insulating film disposed on the fourth coil layer; and a second via penetrating through the third insulating film and electrically connecting the third and fourth coil layers.

9. The coil component of claim 4, wherein the coil part further includes a through conductor penetrating through the support member and electrically connecting the first and third coil layers.

10. The coil component of claim 4, wherein the first to fourth coil layers are electrically connected to each other to form one coil, and the electrode includes:

a first electrode connected to an end portion of the second coil layer, and a second electrode connected to an end portion of the fourth coil layer.

11. The coil component of claim 4, wherein the first and second coil layers are connected to each other to form one coil, the third and fourth coil layers are connected to each other to form another coil, and the electrode includes:

a first electrode connected to an end portion of the first coil layer, a second electrode connected to an end portion of the second coil layer, a third electrode connected to an end portion of the third coil layer, and a fourth electrode connected to an end portion of the fourth coil layer.

12. The coil component of claim 1, wherein the support member includes a glass fiber and an insulating resin.

13. A coil component, comprising:

a support member;

a first coil layer disposed on one surface of the support member;

a second coil layer disposed on the first coil layer;

a third coil layer disposed on another surface of the support member opposite to the one surface;

a fourth coil layer disposed on the third coil layer;

external electrodes connected to ends of the second and fourth coil layers, wherein each of the first, second, third, and fourth coil layers includes a coil conductor comprising a seed layer and a plating layer, and wherein the seed layers of the first and third coil layers are mutually symmetrical about a center plane of the support member, and each have different shapes from the seed layers of the second and fourth coil layers which are mutually symmetrical about the center plane of the support member.

14. The coil component of claim 13, further comprising:

a through conductor penetrating through the support member to directly electrically connect the first and third coil layers to each other.

15. The coil component of claim 14, wherein the seed layers and plating layers of each of the first and third coil layers extend through the through conductor to electrically connect the first and third conductor layers.

16. The coil component of claim 13, further comprising:

a first insulating film disposed directly on the first coil layer, having the second coil layer disposed directly thereon, and having a first via penetrating therethrough to connect the coil conductors of the first and second coil layers to each other; and a second insulating film disposed directly on the third coil layer, having the fourth coil layer disposed directly thereon, and having a second via penetrating therethrough to connect the coil conductors of the third and fourth coil layers to each other.

17. The coil component of claim 16, wherein the seed layer of the second coil layer extends through the first via to directly contact the coil conductor of the first coil layer, and wherein the seed layer of the fourth coil layer extends through the second via to directly contact the coil conductor of the third coil layer.

18. The coil component of claim 16, wherein the seed layers of each of the first and third coil layers are disposed in a planar coil pattern directly on a respective one of the one and the other surface of the support member to extend on only one surface from among surfaces of the plating layers of each the first and third coil layers, wherein the seed layers of the second and fourth coil layers are disposed in a planar coil pattern on the first and second insulating films respectively, and extend along lateral surfaces of the coil conductors of the second and fourth coil layers, and wherein the plating layer of the second and fourth coil layers each fill a space between the extensions of the seed layers on the lateral surfaces.

19. The coil component of claim 13, wherein each of the first, second, third, and fourth coil layers includes an insulating layer disposed to form a planar coil pattern, and the insulating layers each include a mixture of an insulating resin and a magnetic filler.

* * * * *